US006527034B1

(12) United States Patent
Liu

(10) Patent No.: US 6,527,034 B1
(45) Date of Patent: Mar. 4, 2003

(54) SLAT-POSITIONING DRUM FOR A VENETIAN BLIND

(76) Inventor: Tai-Ping Liu, No. 15, Alley 8, Lane 3, Kuo-Chi St., Lung-Ching Hsiang, Taichung Hsien (TW)

( * ) Notice: Subject to any disclaimer, the term of this patent is extended or adjusted under 35 U.S.C. 154(b) by 0 days.

(21) Appl. No.: 09/943,624

(22) Filed: Aug. 30, 2001

(51) Int. Cl.[7] ..... E06B 9/38

(52) U.S. Cl. ..... 160/177 R; 160/168.1 R; 160/176.1 R

(58) Field of Search ..... 160/166.1 R, 167 R, 160/168.1 R, 173 R, 174 R, 176.1 R, 177 R, 178.1 R

(56) References Cited

U.S. PATENT DOCUMENTS 4,334,572 A * 6/1982 Frei ..... 160/170
4,821,789 A * 4/1989 Van Rens ..... 160/176.1
5,074,349 A * 12/1991 Yannazzone ..... 160/177
5,139,073 A * 8/1992 Opdahl et al. ..... 160/177
5,267,598 A * 12/1993 Marocco ..... 160/177
5,538,068 A * 7/1996 Liu ..... 160/177
5,573,052 A * 11/1996 Liu ..... 160/177 R
6,279,642 B1 * 8/2001 Liu ..... 160/177 R
6,321,820 B1 * 11/2001 Liu ..... 160/177 R

* cited by examiner

*Primary Examiner*—Bruce A. Lev
(74) *Attorney, Agent, or Firm*—Thomas, Kayden, Horstemeyer & Risley, LLP

(57) ABSTRACT

A slat-positioning drum is rotatably mounted in a positioning base fixedly mounted in a head rail of a venetian blind and includes a hollow upper section and a top plate. Two parallel channels are each longitudinally defined in the upper section of the body and each has a closed end and an open end. The two closed ends of the two channels are opposite to each other. Two parallel grooves are each longitudinally defined in the top plate and respectively communicate with a corresponding one of the two channels. Multiple teeth are formed on each of two edges defining each of the two grooves. A connecting rod is formed in each channel and is located below the corresponding groove. Each connecting rod extends from the closed end of the channel.

1 Claim, 6 Drawing Sheets

SLAT-POSITIONING DRUM FOR A VENETIAN BLIND

BACKGROUND OF THE INVENTION

1. Field of the Invention

The present invention relates to a positioning drum, and more particularly to a slat-positioning drum for a Venetian blind.

2. Description of Related Art

With reference FIG. 7, a first conventional slat-positioning drum (60) for a venetian blind (not shown) in accordance with the prior art is rotatably mounted in a retaining base (not shown) which is fixedly mounted in a head rail (not shown) of the venetian blind. The slat-positioning drum (60) has a top, a front side, a rear side, two ends and a central axis parallel to the top and sides. A rotary shaft (not shown) extends through an axial bore (62) longitudinally defined along the central axis of the drum (60) to control rotational movement of the drum (60). A pair of retaining clips (61) are formed on the top of the slat-positioning drum (60). Each retaining clip (61) has a proximal end (612) fixedly formed on the top of the slat-positioning drum (60) and a free distal end slightly separated from the top of the slat-positioning drum (60). A slit (611) is defined between each of the retaining clips (61) and the top of the slat-positioning drum (60). A pair of slat cords (41) is clipped under the retaining clips (61). Each slat cord (41) has a first free end that extends through a corresponding one of the slits (611). A rigid tag is attached to the free end of each of the cords (41) and is securely retained by the fixed distal end (612) of the associated retaining clip (61). Each of the two cords (41) has a second free and extending downwardly to fasten one side of a plurality of slats (not shown) so as to control the angular position of the plurality of slats.

With such an arrangement, the retaining clip (61) is easily detached from the fixed distal end (612) of the retaining clip (61) such that the free end of the cord (41) is easily released from the slit (611).

With reference to FIG. 8, a second conventional slat-positioning drum (50) for a venetian blind (not shown) in accordance with the prior art is rotatably mounted in a retaining base (not shown) which is fixedly mounted in a head rail (not shown) of the venetian blind. The slat positioning drum (50) has a flat top surface (51), a front side, a rear side, two ends and a central axis parallel to the top and sides. A rotary shaft (not shown) extends through an axial bore (56) longitudinally defined along the central axis of the drum (50) to control rotational movement of the drum (50). Two mounting clips, each consisting of a long tongue (52) and short tongue (53), are formed on the top surface (51) of the drum (50) with a space (58) between the tongues (52, 53). One pair is formed near the front side of the drum (50), and the other is formed near the rear side of the drum (50). A slit (54) is defined between each tongue (52, 53) and the flat top surface (51). A pair of flexible slat tapes (40) is selectively attached to the drum (50). Each flexible slat tape (40) has a loop (not numbered) formed on a first free end such that a corresponding pair of long and short tongues (52, 53) are inserted into the loop to hold the free end of each of the tape (40) in place. Each of the two tapes (40) has a second free end extending downward to hold a plurality of slats (not shown) and control angular position of the slats.

Because the space (58) between the long and short tongues (52, 53) is short, it is not easy insert the loop of the first free end of the tapes (40) on the tongues (52, 53). If the space (58) between the tongues (52, 53) is large enough to easily connect the loops to the tongues (52, 53), the loop is easily released from the tongues (52, 53).

The present invention has arisen to mitigate and/or obviate the disadvantages of conventional slat-positioning drums for Venetian blinds.

SUMMARY OF THE INVENTION

The main objective of the present invention is to provide an improved slat-positioning drum that has a rigid engaging structure and makes the associated assembly of the venetian blind easier. To achieve the objective, the slat-positioning drum in accordance with present invention comprises a body having a hollow upper section, two ends, a front side, a rear side and a top plate. Two parallel channels are longitudinally defined in the upper section of the body, and each channel has a closed end and an open end. The closed ends of the two channels are opposite to each other. Two parallel grooves are each longitudinally defined in the top plate and respectively communicate with one of the two corresponding channels. Multiple teeth are formed on each of two sides defining each of the two grooves. An elongated rod is formed in each of the two channels and is located below an associated groove. The elongated rods extend from the corresponding closed ends of the channels.

Further benefits and advantages of the present invention will become apparent after a careful reading of the detailed description with appropriate reference to the accompanying drawings.

DETAILED DESCRIPTION OF THE INVENTION

Figure 1:
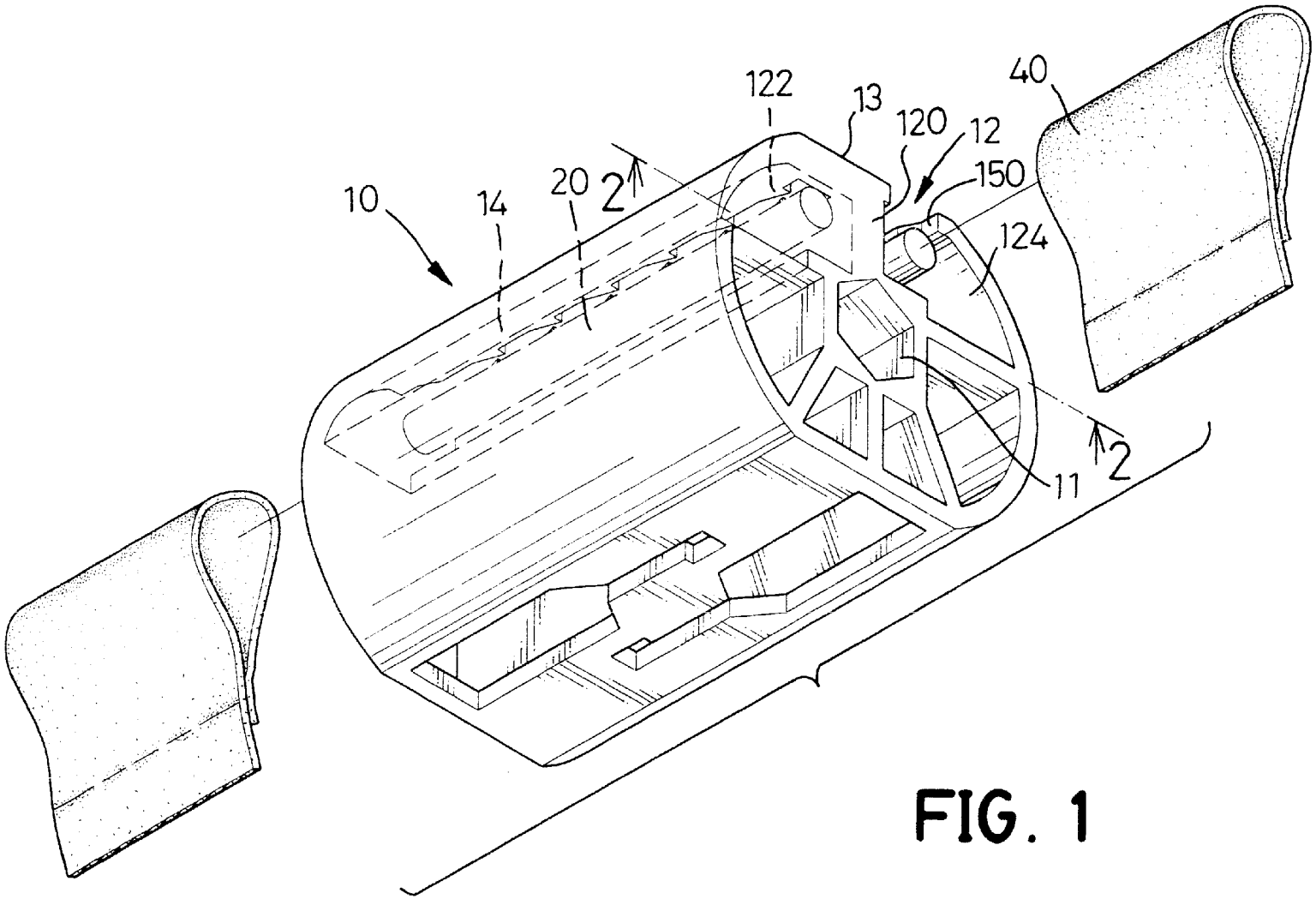
FIG. 1 is a perspective view of a slat-positioning drum for a venetian blind in accordance with the present invention.

With reference to FIGS. 1–4 and 6, a slat-positioning drum in accordance with the present invention is used with a venetian blind (3). A venetian blind (3) comprises a head rail (32), at least one positioning base (30), a corresponding number of slat-positioning drums (10), a pair of flexible slat tapes (40) for each slat-positioning drum (10) and multiple slats (34). The head rail (32) has a substantially U-shaped cross-section. Each positioning base (30) is securely mounted in the head rail (32). One end of each pair of flexible slat tapes (40) is connected to the corresponding slat-positioning drum (10). The slats (34) are individually mounted one above the other between the flexible slat tapes (40) in each pair.

The slat-positioning drum (10) is rotatably mounted in the positioning base (30) and comprises an upper section (12) having a semicircular front side, a semicircular rear side, two flat ends, a flat top plate (13), a central axis between the two flat ends, a mediate section and a lower section.

A polygonal axial passage (11) is longitudinally defined through the mediate section along the central axis. A polygonal elongated control shaft (31) extends through and engages with the axial passage (11) to rotate and hold the slat-positioning drum (10).

Two parallel channels (14) are longitudinally defined in the upper section (12) of the slat-positioning drum (10). Each of the channels (14) has a closed end (122) and an open end (124). The closed ends (122) of the two channels are on opposite ends of the slat-positioning drum (10). A groove (15) is longitudinally defined in the top plate (13) of the upper section (12) of the slat-positioning drum (10) above each channel (14). Each of the grooves (15) communicates with the corresponding channel (14). Correspondingly, the two grooves (15) respectively begin at the open ends (124) of the channels (14) and terminates near the closed ends (122) of the channels (14).

Preferably, a longitudinal reinforcing baffle (120) is formed between the two channels (14) in the upper section (12) of the slat-positioning drum (10) . The reinforcing baffle (120) is securely attached to or integrally formed on an underside of the top plate (13).

A flare (150) is formed on the end of each groove (15) at the open end (124) of the channel (14). Multiple teeth (152) are formed on the longitudinal edges (not numbered) defining each of the two grooves (15). Each of the teeth (152) has an incline (154) facing the open end (124) of the channel (14) and has a perpendicular step (156) at the end of each incline (154) nearest the closed end (122) of each of the two channels (14).

Figure 2:
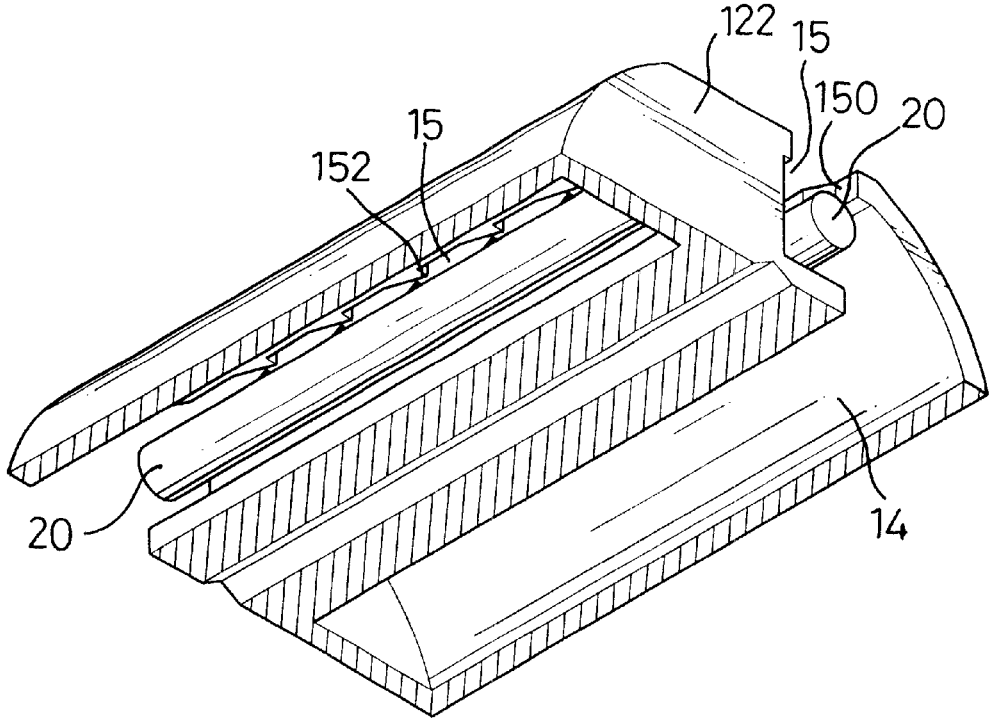
FIG. 2 is a cross sectional perspective view of the slat-positioning drum in FIG. 1 for a venetian blind.
Figure 5:
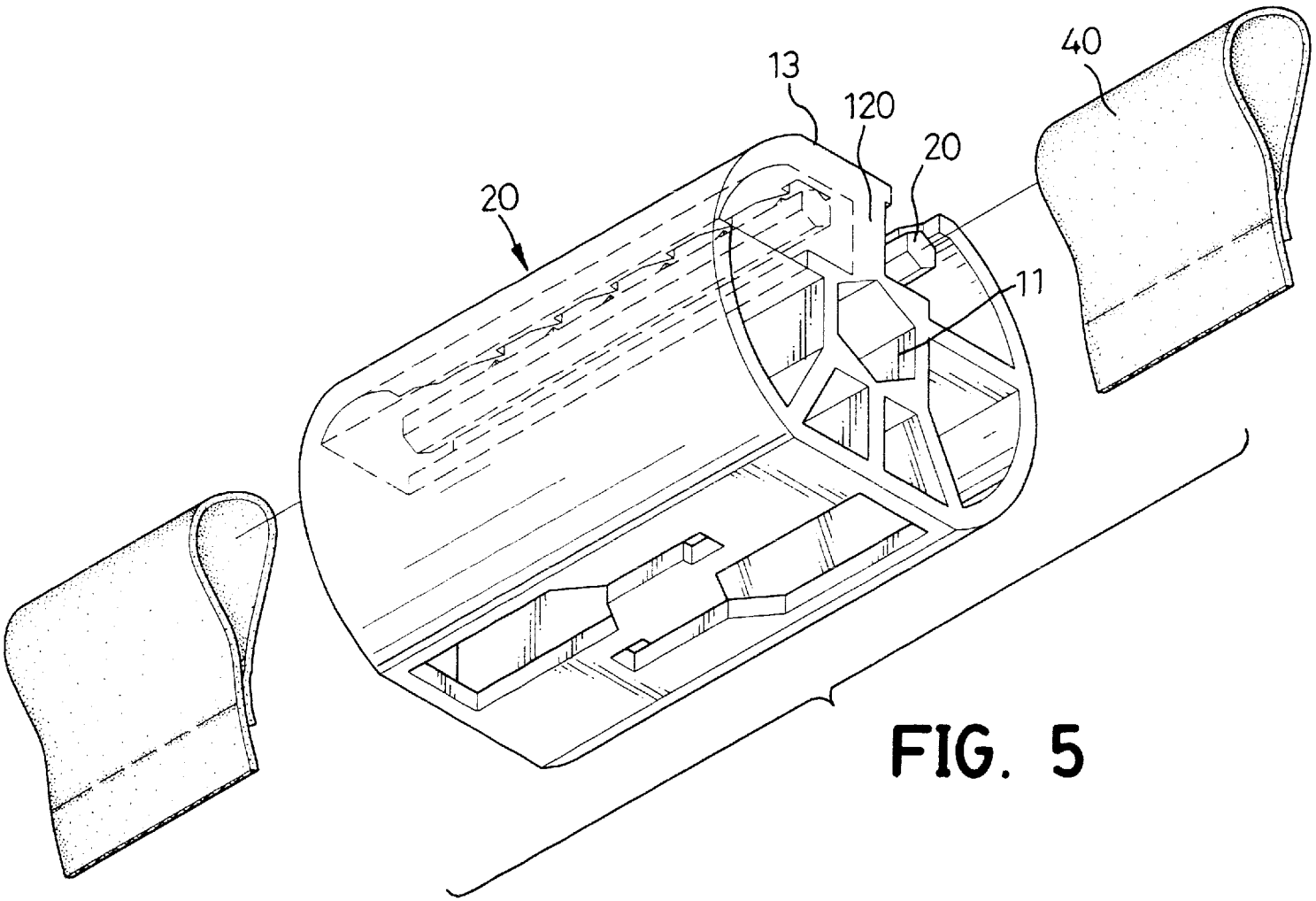
FIG. 5 is a perspective view of another embodiment of a slat-positioning drum for a venetian blind in accordance with the present invention.

A connecting rods (20) is formed in each channel (14) below the corresponding groove (15). With reference to FIGS. 1, 2 and 5, the connecting rods (20) are either round or polygonal. Each of the two connecting rods (20) has a distal end securely attached to or integrally formed with the closed end (122) of each of the channels (14).

Figure 3:
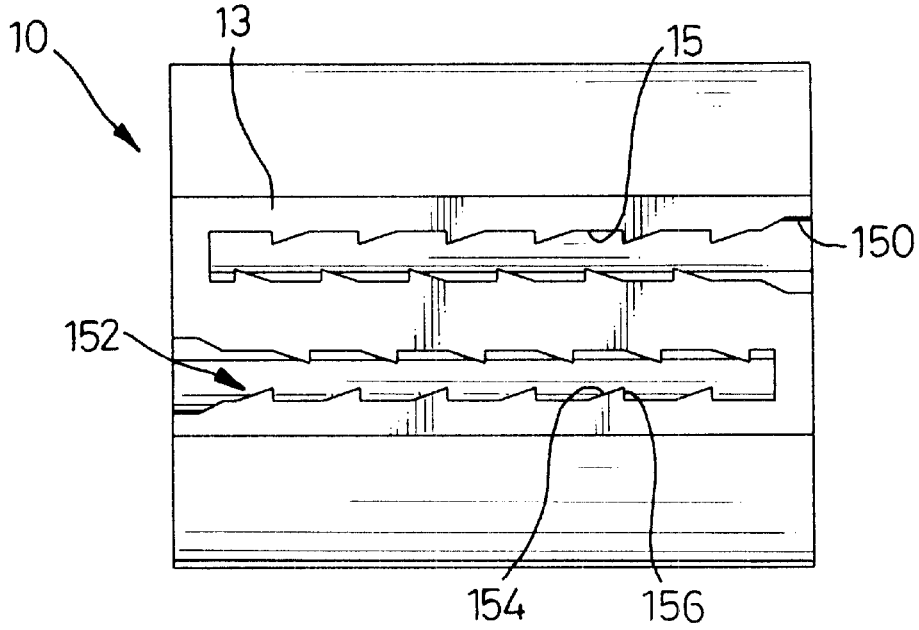
FIG. 3 is a top plan view of the slat-positioning drum in FIG. 1 for a venetian blind.
Figure 4:
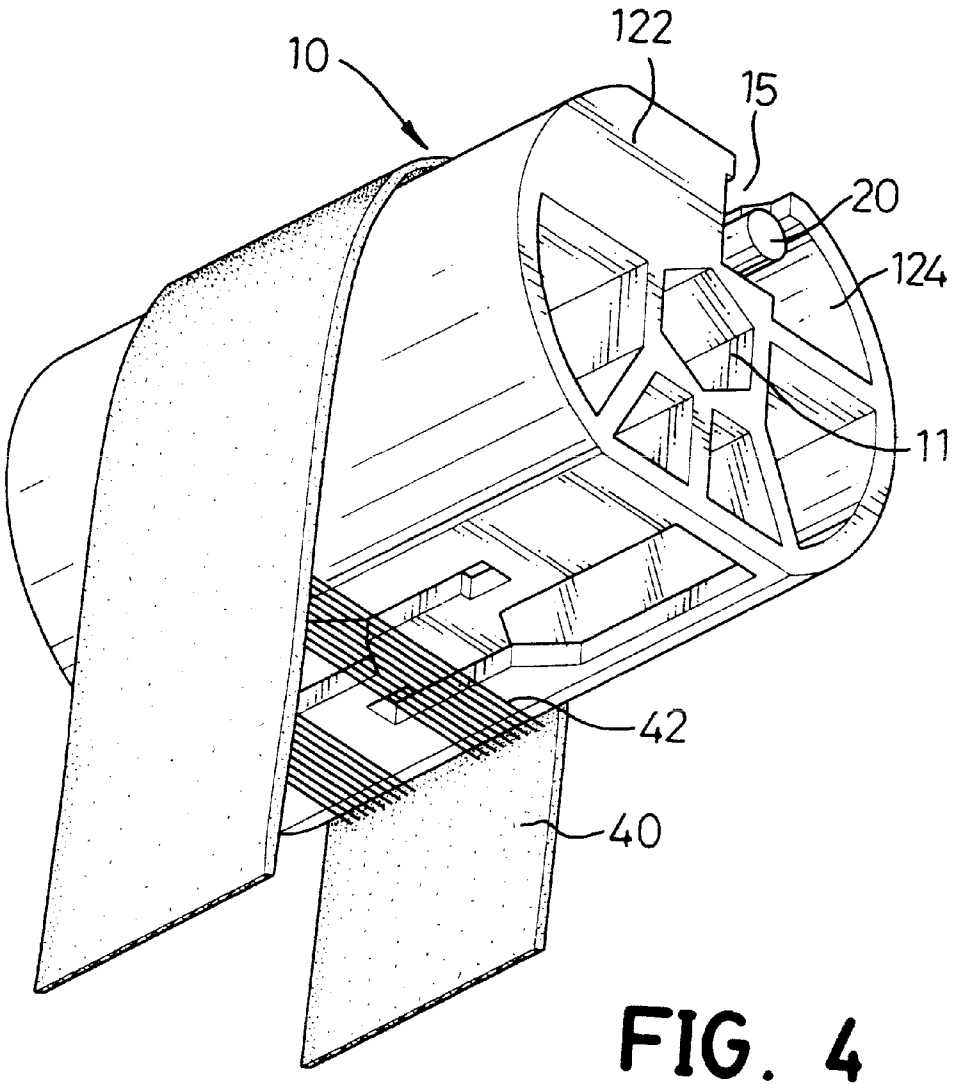
FIG. 4 is a perspective assembly view of the slat-positioning drum in FIG. 1 for a Venetian blind.
Figure 6:
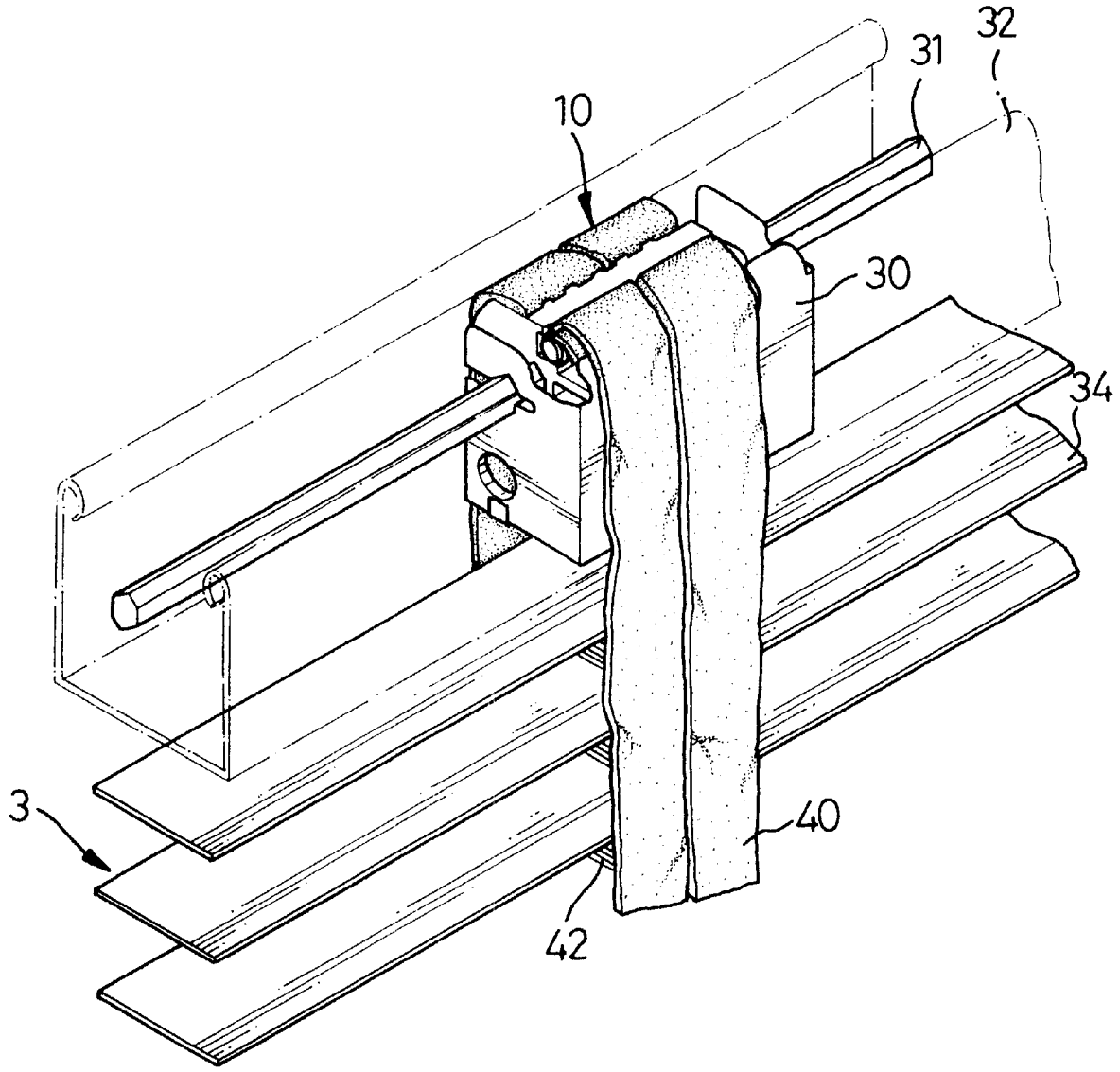
FIG. 6 is an operational perspective view of the slat-positioning drum in FIG. 1 in combination with a venetian blind.
Figure 7:
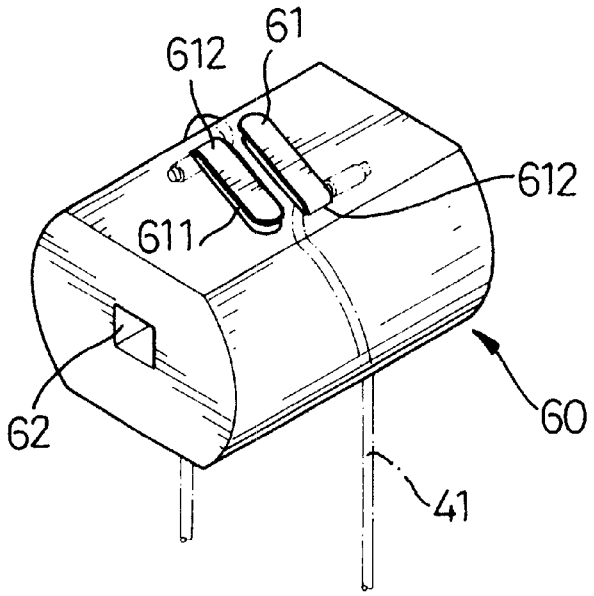
FIG. 7 PRIOR ART
FIG. 7 is a perspective view of a first conventional slat-positioning drum for a venetian blind in accordance with the prior art.
Figure 8:
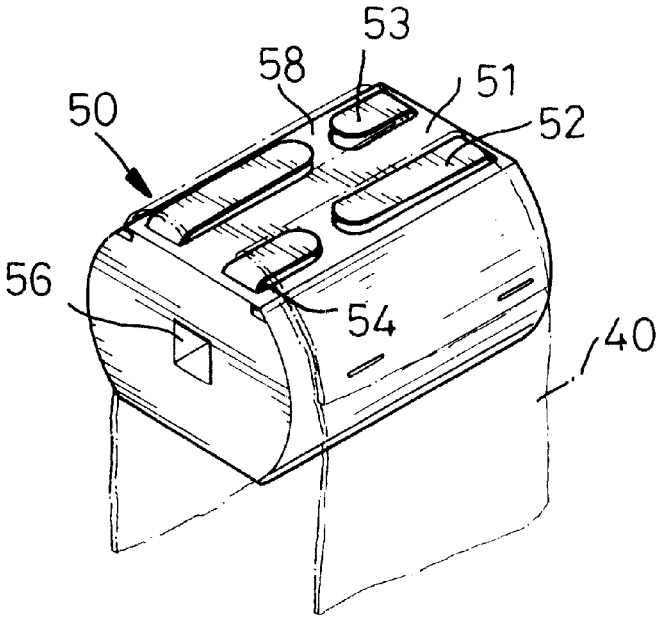
FIG. 8 PRIOR ART
FIG. 8 is a perspective view of a second conventional slat-positioning drum for a venetian blind in accordance with the prior art.

With reference to FIGS. 3, 4, and 6, a loop is formed on the end of each flexible slat tape (40). The loop in each of the two flexible slat tapes (40) is inserted into the flare (150) in the groove (15) in the channel (14) around the connecting rod (20). With the loops on the slat tapes (40) around the corresponding connecting rods (20) and in the corresponding grooves (15), the slat tapes (40) are retained by the multiple teeth (152) and are prevented from being released from the teeth (152) by means of the steps (156) of the teeth (152).

Each of the two flexible tapes (40) also includes a second free end extending downward from opposite sides of the drum (10). Multiple supporting webs (42) extend between the two flexible tapes (40) to support an end of one of the multiple slats (34) to control the angular movement and angle of the slats (34).

Accordingly, the slat-positioning drum (10) for a venetian blind in accordance with the present invention is easy to assemble and has a rigid engaging structure. In addition, the slat-positioning drum (10) can perform two functions suitable for a type of venetian blind with multiple slats whose angular movement and rotational angles are controlled by cords or tapes.

Although the invention has been explained in relation to its preferred embodiment, it is to be understood that many other possible modifications and variations can be made without departing from the spirit and scope of the invention as hereinafter claimed.

What is claimed is:

1. A slat-positioning drum for a venetian blind that comprises a head rail having a substantially U-shaped cross-section, at least one positioning base securely mounted in the head rail, a corresponding number of slat-positioning drums, a pair of flexible slat tapes for each slat positioning drum and multiple slats, the slat-positioning drum being adapted to be rotatably mounted in the positioning base and comprising:

a body having an upper section, a top plate formed on a top of the body, a mediate section and lower section;

a polygonal passage longitudinally defined through the mediate section of the body, the polygonal passage adapted to receive a polygonal shaft of the venetian so that the body can be rotated by the polygonal shaft of the venetian blind;

two channels each longitudinally defined in the upper section of the body and each having a closed end and an open end, the closed ends of the two channels on opposite ends of the body;

two grooves each longitudinally defined in the top plate of the body, each being defined by two edges and communicating with a corresponding one of the two channels;

multiple teeth formed on each of the two edges of each of the two grooves;

two connecting rods each in a corresponding one of the two channels and located below a corresponding groove, each of the connecting rods integrally extending from a closed end of the corresponding channel;

a reinforcing baffle formed in the upper section of the body, the reinforcing baffle located between the two channels and integrally extending from an under side of the top surface; and a flare formed on each of the two edges defining each of the two grooves and located at the open end of the channels, where each connecting rod is polygonal.

* * * * *